US011111670B2

(12) United States Patent
Konings

(10) Patent No.: US 11,111,670 B2
(45) Date of Patent: Sep. 7, 2021

(54) CANOPY FOR SELECTIVELY COVERING AN AREA

(71) Applicants: RICO SPORT & VASTGOED B.V., Sprundel (NL); Marinus Konings, Sprundel (NL)

(72) Inventor: Marinus Konings, Sprundel (NL)

(73) Assignee: RICO SPORT & VASTGOED B.V., Sprundel (NL)

( * ) Notice: Subject to any disclaimer, the term of this patent is extended or adjusted under 35 U.S.C. 154(b) by 0 days.

(21) Appl. No.: 16/615,776

(22) PCT Filed: May 30, 2018

(86) PCT No.: PCT/NL2018/050355
§ 371 (c)(1),
(2) Date: Nov. 21, 2019

(87) PCT Pub. No.: WO2018/222038
PCT Pub. Date: Dec. 6, 2018

(65) Prior Publication Data

US 2020/0087912 A1 Mar. 19, 2020

(30) Foreign Application Priority Data

Jun. 2, 2017 (NL) ..... 2019017

(51) Int. Cl.
*E04B 1/24* (2006.01)
*E04H 15/18* (2006.01)
(Continued)

(52) U.S. Cl.
CPC ..... *E04B 7/166* (2013.01); *E04B 1/24* (2013.01); *E04B 1/3205* (2013.01); *E04B 1/342* (2013.01);
(Continued)

(58) Field of Classification Search
CPC ..... A01G 9/16; A01G 9/1407; E04H 15/64; E04H 15/18; E04H 15/54; E04H 15/34;
(Continued)

(56) References Cited

U.S. PATENT DOCUMENTS 3,741,631 A * 6/1973 Laing ..... E06B 9/24 359/228
4,038,788 A * 8/1977 Claessens ..... E04B 7/166 52/2.17
(Continued)

FOREIGN PATENT DOCUMENTS

FR 2497860 A1 7/1982
FR 2558869 A1 8/1985
NL 8901848 A 2/1991

OTHER PUBLICATIONS

International Search Report and Written Opinion for the International Patent Application No. PCT/NL2018/050355, dated Sep. 12, 2018, 10 pages.

*Primary Examiner* — Phi D A
(74) *Attorney, Agent, or Firm* — Kacvinsky Daisak Bluni PLLC

(57) ABSTRACT

A canopy for selectively covering an area, such as a sports field includes at least two beams which span the area, at least two cross beams which are displaceable along the beams, a cloth which is attached to the cross beams, a drive which is configured to displace the cross beams with the cloth attached thereto along the beams, and a substantially flexible tensioning member fastened between the cross beams.

16 Claims, 6 Drawing Sheets

(51) Int. Cl.

| | |
|---|---|
| ***E04H 3/14*** | (2006.01) |
| ***E04B 7/16*** | (2006.01) |
| ***E04B 1/32*** | (2006.01) |
| ***E04B 1/342*** | (2006.01) |
| *E04H 15/64* | (2006.01) |

(52) U.S. Cl.
CPC ..... *E04H 3/14* (2013.01); *E04B 2001/3252* (2013.01); *E04H 15/18* (2013.01); *E04H 15/64* (2013.01)

(58) Field of Classification Search
CPC ..... E04H 4/10; E04H 4/086; E04H 15/46; E04H 15/405; E04H 3/14; E04H 4/108; E04H 3/165; E04B 1/34357; E04B 7/166; E04B 1/24; E04B 2001/3252; E04B 1/342; E04B 1/3205; E04B 2001/2487; E04B 2001/2493; E04D 5/00; E04D 5/06
See application file for complete search history.

(56) References Cited

U.S. PATENT DOCUMENTS 4,118,904 A * 10/1978 Sprung ..... E04H 15/18 135/119
4,229,914 A * 10/1980 Lucas ..... E04H 15/644 135/124
4,452,230 A * 6/1984 Nelson ..... F24S 20/67 126/621
4,727,688 A * 3/1988 Kida ..... E04B 7/166 52/6
4,805,355 A * 2/1989 Plant ..... E04B 7/14 52/1
5,333,425 A * 8/1994 Nickerson ..... E04H 15/18 160/383
5,564,234 A * 10/1996 Vermeulen ..... A01G 9/242 52/63
5,715,634 A * 2/1998 Schultz ..... E04D 3/08 52/200
6,082,054 A * 7/2000 Silberman ..... E04B 7/166 52/6
6,145,526 A * 11/2000 Quiring ..... E04H 15/18 135/115
7,285,719 B2 * 10/2007 Conger ..... H02S 20/10 136/245
2004/0074152 A1 * 4/2004 Rogers ..... A62C 3/0257 52/3
2004/0177582 A1 * 9/2004 Adriaansen ..... E04D 3/28 52/537
2004/0187397 A1 * 9/2004 Chapus ..... E04H 4/084 52/67
2007/0051054 A1 * 3/2007 Devincenzo ..... A01G 9/242 52/72
2009/0031641 A1 * 2/2009 Grazioso ..... E04F 10/02 52/74
2009/0188161 A1 * 7/2009 Van Dijk ..... A01G 9/14 47/17
2012/0180838 A1 * 7/2012 Stafford ..... E04H 15/34 135/157
2013/0318885 A1 * 12/2013 Griffis ..... E04B 1/34357 52/2.11
2015/0233139 A1 * 8/2015 Neumann ..... E04H 15/505 135/122
2016/0262318 A1 * 9/2016 Lloyd ..... E04F 10/0614
2017/0001733 A1 * 1/2017 Larson ..... E04H 15/52
2019/0283842 A1 * 9/2019 Bejrowski ..... E04B 1/34368

* cited by examiner

CANOPY FOR SELECTIVELY COVERING AN AREA

This is a national stage application filed under 35 U.S.C. § 371 of pending international application PCT/NL2018/050355 filed May 30, 2018, which claims priority to Netherlands Patent application NL 2019017, filed Jun. 2, 2017, the entirety of which applications are hereby incorporated by reference herein.

The invention relates to a canopy for selectively covering an area, such as a sports field.

In climates where the weather conditions, and particularly the outdoor temperature, fluctuate greatly a canopy which can be selectively arranged can provide advantages. A swimming pool or sports field, such as a tennis court, can thus be used in the open air when the weather is good, while in cold or wet conditions use can be made of a heated and dry playing environment.

For tennis accommodations it is known in the winter season to arrange a so-called, air-inflated structure over tennis courts which are open-air during the summer season. Such an air-inflated structure however consumes a large amount of energy in order to remain continuously inflated and at a desired temperature. In addition, putting up and taking down such an air-inflated structure is very labour-intensive and time-consuming, and thereby expensive. The operational costs of an air inflated structure for four tennis courts can amount to about €60,000 for half a year. These costs can be split into about €40,000 in energy costs and €20,000 for the cost of putting up and taking down. A further drawback is that such an air-inflated structure cannot be temporarily opened on a day or in a week with nice weather. In addition, such air-inflated structures are not very storm-resistant, which can be partially obviated by temporarily increasing the pressure. This is of course accompanied by a temporary increase in energy consumption, and it requires an active decision on the part of the manager of the air-inflated structure.

Other applications wherein a canopy which can be selectively arranged and removed can provide advantages are playing fields, event sites, playgrounds, riding stables, animal accommodations and so on. Such a canopy can of course also be applied in horticulture.

NL 8 901 848 A is deemed the closest prior art. This publication discloses a canopy for covering an area, consisting inter alia of a number of rafters connected by beams, trusses on which one or two roof coverings of foldable material are arranged, and tensioning cables driven by electric motors for the purpose of displacing the roof covering. This known canopy however has the drawback that, when moving to cover the area from an uncovered state thereof, the tensioning cables driven by the electric motors transfer their tensile force directly to the roof covering of foldable material. This has the result that the roof covering wears relatively quickly during use of the canopy and, in addition, has to take an especially heavy form so as to be able to withstand the tensile forces exerted thereon. Both the wear and the required heavier form of the roof covering of course entail the necessary additional measures and costs. The drive will thus inter alia have to be sufficiently powerful to be able to displace the relatively strong and thick, and thereby heavy, cloth.

Another drawback of the canopy disclosed by the above stated patent specification is that this canopy comprises two mutually connected roof coverings which can only be applied in combination.

A further drawback of the canopy known from the above stated patent specification is that, when moving to cover the area from an uncovered state thereof, the electric motors driving the tensioning cables must produce a particularly great force in order to displace the roof covering(s). In addition, this required force increases further as a greater part of the roof covering(s) is displaced in the direction of the ridge of the canopy, where the electric motors are arranged. This known canopy hereby requires a particularly powerful electric motor which is able to produce these forces. Because the tensioning cables pull on the cloths, the cloths consequently have to take a strong and thick form. As a result thereof, the cloths are relatively heavy and the electric motors have to be sufficiently powerful to enable the heavy cloth to be displaced. These particularly great forces moreover have an adverse effect in respect of wear of the canopy as a whole and the material of the roof covering(s) in particular.

Further prior art publications are the French patent documents FR 2 497 860 A1 and FR 2 558 869 A1, the American patent document US 2015/068569 A1 and the international patent documents WO 2005/027620 A1 and WO 2012/072960 A1.

The invention now has for its object to provide a canopy device of the above described type, wherein said drawbacks do not occur, or at least do so to lesser extent.

Said object is achieved according to the invention with a canopy for selectively covering an area, such as a sports field, comprising:

- at least two beams which span the area;
- at least two cross beams which are displaceable along the beams;
- a cloth which is attached to the cross beams;
- a drive which is configured to displace the cross beams with the cloth attached thereto along the beams; and
- a substantially flexible tensioning member fastened between the cross beams.

Displacing the cross beams with the cloth attached thereto over the beams using the drive enables the area to be covered selectively. With such a canopy an area can be covered, or conversely be exposed, in a relatively short period of time of several minutes. This makes it possible to make very flexible allowance for changing weather conditions. In the case of rain the area can be covered, while the option exists of using the area in the open air when the weather is good.

The beams span the area, thereby providing a storm-resistant structure, both in wholly covered and wholly exposed state of the area. The canopy will however generally be completely closed before a storm comes on.

The substantially flexible tensioning member fastened between the cross beams absorbs tensile forces produced by the drive during covering of the area from an uncovered state thereof. During covering of the area the cloth will hereby not be loaded to great extent by these tensile forces, which considerably reduces wear of the cloth. Because it is not loaded by these tensile forces, the cloth can moreover take a considerably lighter form. The cloth can be thinner, which on the one hand saves material and which is advantageous in handling and manufacturing of the cloth. The overall weight of the cloth will on the other hand turn out to be relatively light, which makes it possible to suffice with a drive which need only produce a relatively small force, this also entailing a cost saving.

The tensioning member is preferably embodied as a cord or a tensioning strap.

In a preferred embodiment the beams have an arcuate form and at least one cross beam is weighted in relation to the at least one other cross beam. This embodiment has the advantage that gravity acting on this weighted cross beam assists the drive in further closing and/or opening the canopy when this cross beam is situated on a strongly inclining part of the arcuate beams during covering or exposing of the area. When the canopy is closing and has passed the highest point of the span, the force of gravity will contribute to the further displacement of the cloth. The further the canopy comes to lie over the area to be spanned, the more cloth needs to be advanced. It is therefore advantageous that it is precisely from the highest point of the span that use is made of the force of gravity. A specific arcuate form can furthermore increase the force component of the force of gravity as the canopy closes further. Utilizing the force of gravity allows the drive to take a lighter form.

In a further preferred embodiment the canopy comprises an additional cross beam with an additional cloth attached thereto, wherein the drive, or optionally a separate additional drive, is configured to displace the additional cross beam with the additional cloth attached thereto along the beams independently of the cloth. In this preferred embodiment the canopy comprises two individual canopies which can cover or expose the area independently of each other. This preferred embodiment has the advantage that selectively covering the area with the cloth and the additional cloth makes it possible to make very flexible allowance for changing weather conditions by selectively employing one or more than one of the cloth and the additional cloth. One of the cloth and the additional cloth can also take a more water-repellent, more light-transmitting and/or more thermally insulating form than the other of the cloth and the additional cloth. This makes it possible to make even more flexible allowance for a great variety of changing weather conditions, whereby energy can be saved and the comfort of users of the area is increased considerably.

Further particularly advantageous preferred embodiments form the subject matter of the dependent claims.

Preferred embodiments of the present invention are further elucidated in the following description with reference to the drawing, in which.

Figure 2:
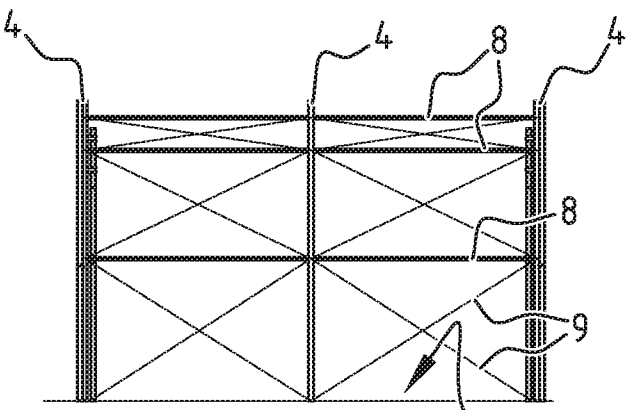
FIG. 2 shows a side view of the frame of FIG. 1.

The invention relates to a canopy 1 for selectively covering an area 2, such as a sports field 3. Canopy 1 comprises at least two beams 4 which span the area 2, and at least one cross beam 5 which is displaceable along beams 4. A cloth 6 is attached to cross beam 5. Canopy 1 further comprises a drive 7 which is configured to displace the cross beam 5 with the cloth 6 attached thereto along beams 4.

Displacing cross beam 5 with cloth 6 attached thereto over beams 4 using drive 7 enables area 2 to be covered selectively and in a relatively short period of time of several minutes. This makes it possible to make very flexible allowance for changing weather conditions.

Beams 4 are disposed parallel relative to each other. In the shown preferred embodiment beams 4 have an arcuate form. Beams 4 are connected to each other in a lattice structure with connecting beams 8 and struts 9, whereby frame 10 of canopy 1 obtains sufficient stiffness.

Figure 1:
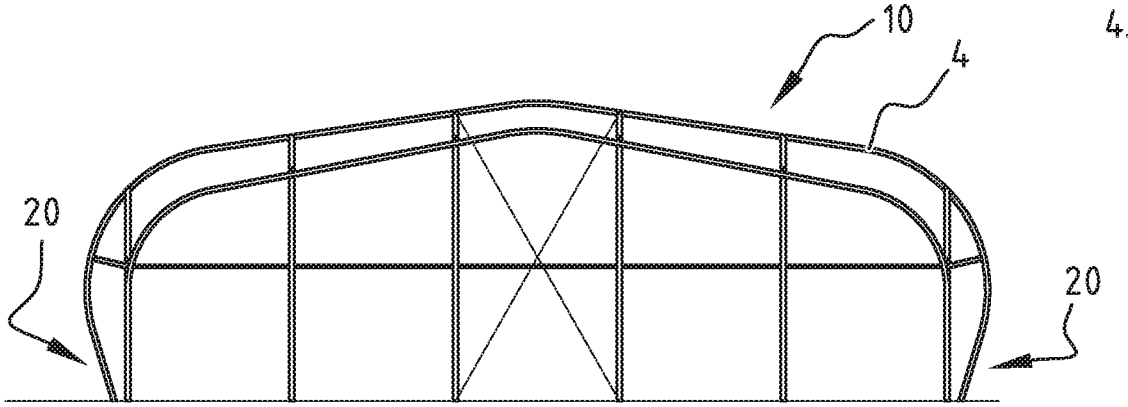
FIG. 1 shows a front view of a frame of beams of a canopy according to the invention.
Figure 3:
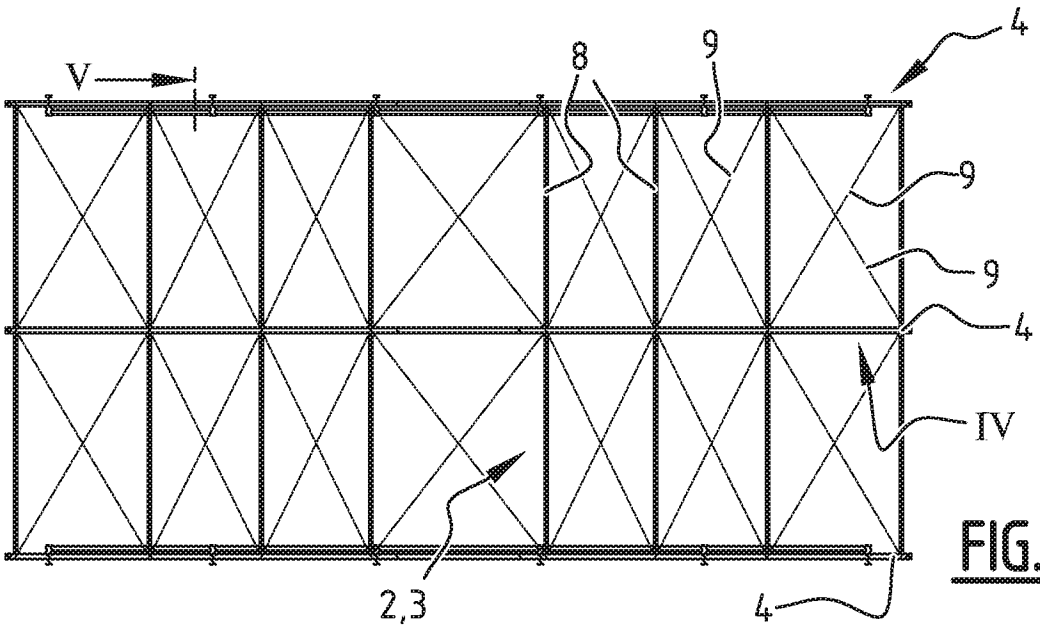
FIG. 3 shows a top view of the frame of FIGS. 1 and 2.
Figure 4:
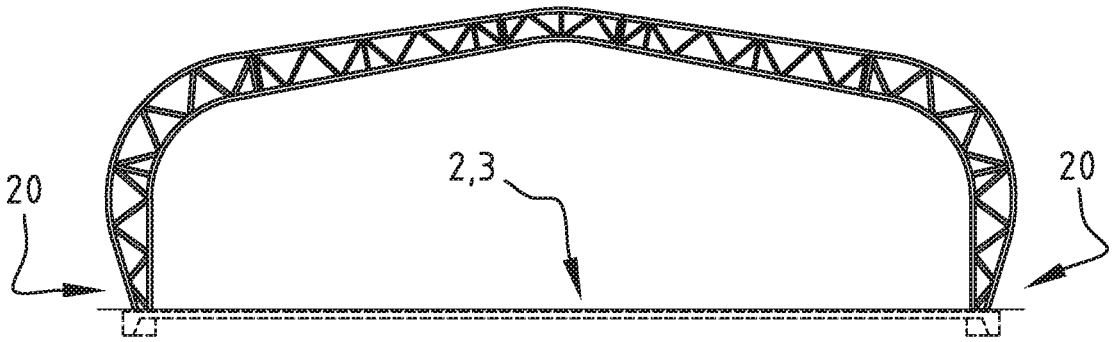
FIG. 4 shows a detailed view of a beam of the canopy of FIGS. 1-3.
Figure 5:
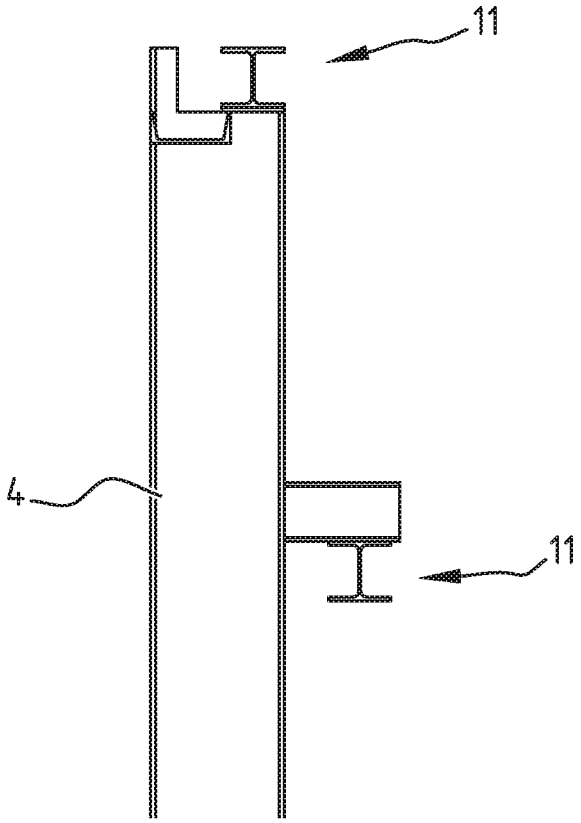
FIG. 5 shows a cross-section through an outer beam of the canopy of FIG. 3.

FIGS. 1-3 show frame 10 in respectively a front view, side view and top view. FIG. 4 shows a lattice structure of the middle beam 4 of FIG. 3 in more detail. FIG. 5 shows an outer beam 4 which is provided with two guides 11 for the cross beams 5.

Figure 6:
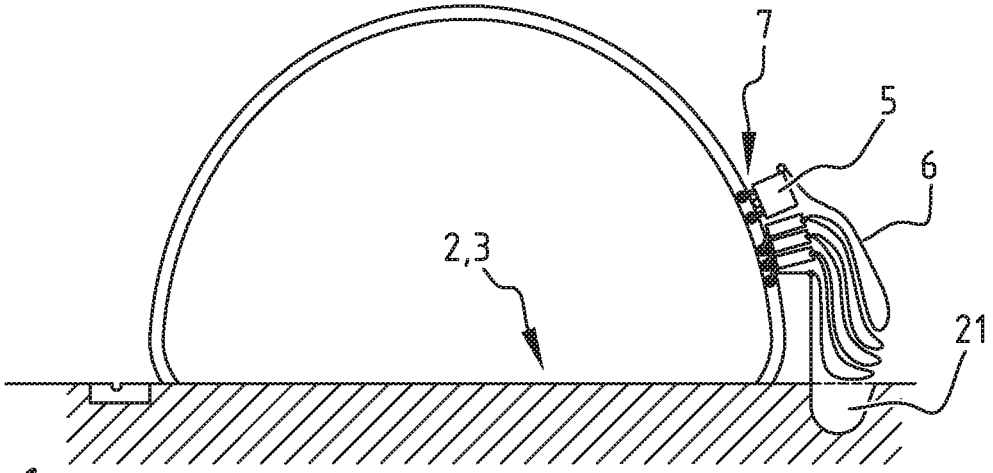
FIGS. 6-8 show a schematic side view of successive steps of the selective covering of an area.
Figure 7:
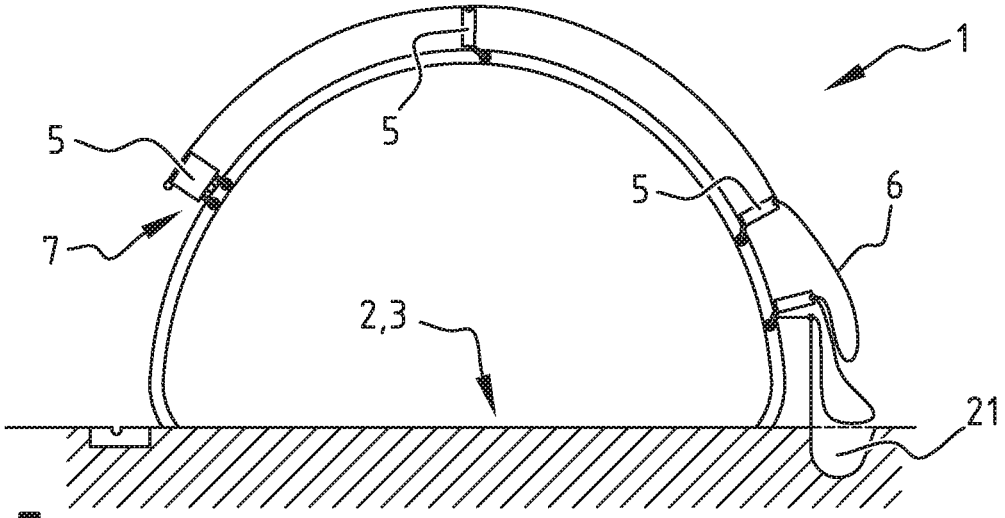
Figure 8:
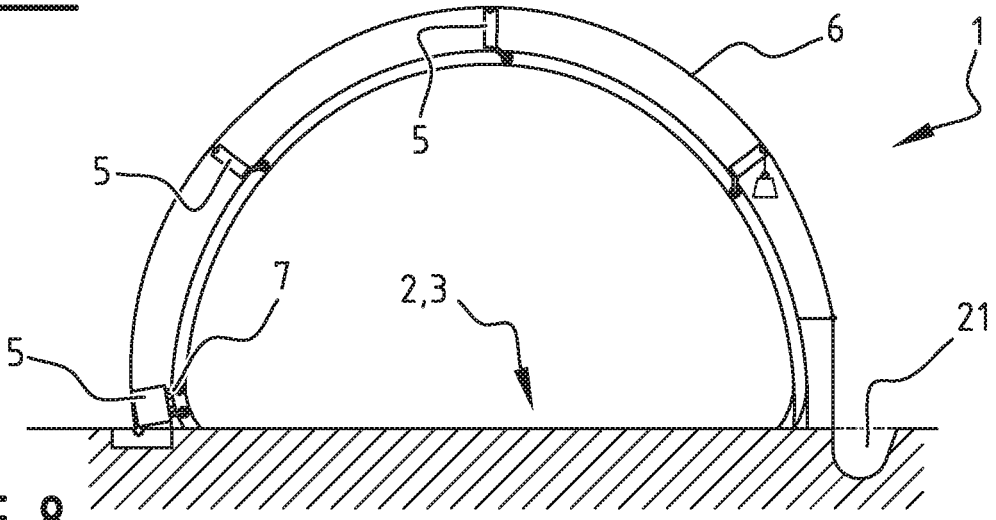

Canopy 1 comprises a plurality of cross beams 5 between which the cloth extends. FIGS. 6-8 show successive steps of the selective covering of area 2 in a simplified schematic side view with four cross beams 5. It is noted that, depending on the area 2 to be covered, a much larger number of cross beams 5 can be provided in practice. The plurality of cross beams 5 which is displaceable along beams 4 comprises at least three cross beams, preferably at least six cross beams, more preferably at least nine cross beams and most preferably at least twelve cross beams. Fifteen to twenty cross beams 5 can for instance be applied for a canopy 1 of a tennis court.

Figure 11:
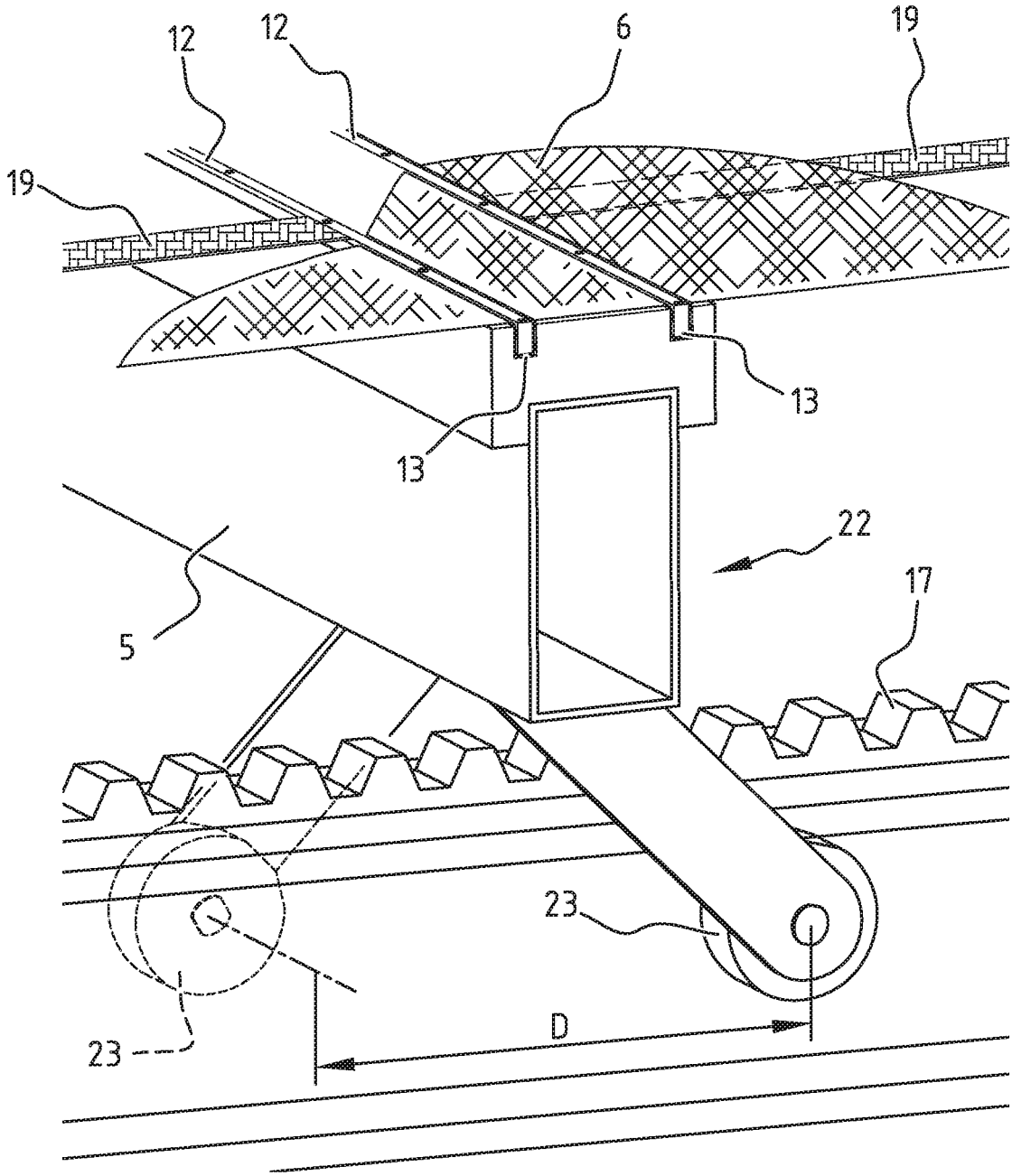
FIG. 11 shows a perspective detail view of a cross beam of the canopy of FIGS. 9 and 10.

In order to provide a watertight canopy 1, cloth 6 is attached watertightly to cross beams 5. Such a watertight attachment can for instance be obtained by clamping the cloth 6. Cross beams 5 preferably comprise a clamp 12. In FIG. 11 clamp 12 is embodied as a strip 12 which can be arranged in a groove 13 of cross beams 5.

It is particularly advantageous for canopy 1 to comprise an additional cloth 14.

Additional cloth 14 can be complementary to cloth 6, wherein cloth 6 and additional 14 can for instance be moved toward each other along beams 4 from opposite sides.

Alternatively, additional cloth 14 cart overlap cloth 6. In the shown embodiments cloth 6 is provided on an outer side of longitudinal beams 4 and additional cloth 14 is provided on an inner side of longitudinal beams 4.

In an overlapping disposition of cloth 6 and additional cloth 14 a space 15 is enclosed therebetween. A heater 16 is preferably provided which is configured to heat the space 15 enclosed between cloth 6 and additional cloth 14.

Varying the properties of cloth 6 and additional cloth 14 makes it possible to make flexible allowance for the (weather) conditions in the selective covering of area 2. One of the cloth 6 and the additional cloth 14 is preferably:

- more water-repellent than the other of the cloth 6 and the additional cloth 14; and/or
- more light-transmitting than the other of the cloth 6 and the additional cloth 14; and/or
- more thermally insulating than the other of the cloth 6 and the additional cloth 14.

On a sunny winter's day a light-transmitting cloth 6 can act as a greenhouse and contribute to the warming up of the covered space. When the sun goes down in the afternoon, the already present heat can be partially trapped by closing an additional cloth 14 with good thermally insulating properties. If desired, the above stated heater 16 can additionally be employed for further heating of the space 1.5 enclosed between cloth 6 and additional cloth 14. Clever use of cloth 6 and additional cloth 14 can save energy.

For some cross beams 5 it is advantageous for cross beam 5 to be weighted. This relates in particular to the cross beams 5 which are situated on a strongly inclining part of the arcuate form in a closed position of cloth 6 or additional cloth 14 of canopy 1. In practice these are the cross beams 5 which are the first or, conversely, one of the last to be displaced when moving to cover area 2 from an uncovered state thereof. These weighted cross beams 5 can hold the cloth taut. By weighting for instance one or more of the last cross beams 5 they are able to contribute to the pulling downward of cloth 6 under the influence of gravity. Cloth 6 can hereby be held taut when canopy 1 is being opened. In a preferred embodiment the weighting of successive cross beams 5 can vary, for instance gradually increase or decrease, in order to achieve an optimal compromise between keeping cloth 6 taut and keeping cross beams 5 as light as possible.

Cross beam 5 preferably comprises drive 7. Arranging drive 7 in cross beam 5 enables it to be strong enough also to span cloth 6 in the case of large spans, such as 40 metres in the case of a tennis court.

The plurality of cross beams 5 more particularly comprises a foremost cross beam 5 which is the first to be displaced when moving to cover area 2 from an uncovered state thereof, and wherein foremost cross beam 5 comprises drive 7. Drive 7 automatically weights the foremost cross beam 5, which is advantageous.

Figure 10:
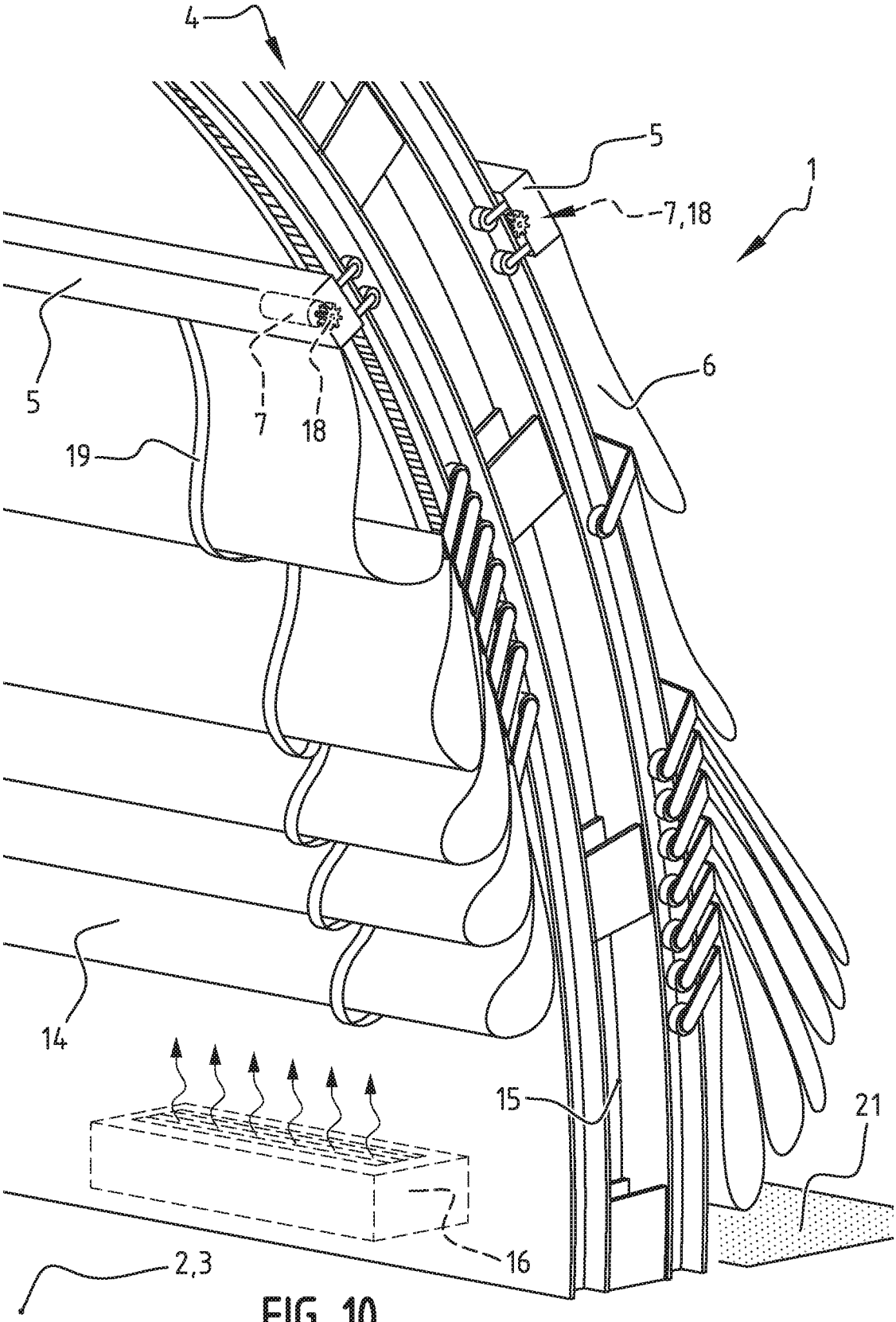
FIG. 10 shows a perspective detail view of the canopy of FIG. 9.

As shown in FIGS. 10 and 11, it is possible to envisage at least one beam 4 comprising a gear rack 17 on which a pinion 18 of drive 7 can engage. As alternative to a gear rack 17 it is for instance also possible to use friction wheels.

FIGS. 10 and 11 further show that a substantially flexible tensioning member 19 is fastened to cross beam 5. This flexible tensioning member 19, which preferably extends between successive cross beams 5, cart fold in accordance with cloth 6 or additional cloth 14 owing to its flexible nature. When cross beams 5 are displaced, tensioning member 19 can however absorb the tensile forces, and thereby relieve cloth 6 or additional cloth 14. This relief will give cloth 6 or additional cloth 14 a longer lifespan. At the same time, the length of the tensioning member between successive cross beams 5 can be chosen such that the cloth is elastically biased to a limited extent. A moderately biased disposition of cloth 6 or additional cloth 14, which reduces flapping of the cloth as a result of wind, can hereby be obtained. Tensioning member 19 is preferably a cord or tensioning strap. A plurality of tensioning members 19 is preferably arranged between two successive cross beams 5, for instance a mutual distance of 1.5 to 2 m apart.

As can best be seen in FIGS. 1 and 4, close to an outer end 20 beam 4 is preferably carved inward, relative to a direction substantially at right angles to the area 2, toward the area 2 to be covered. Cloth 6 hereby lands in controllable manner when canopy 1 is being opened. A receiving gutter 21 for cloth 6 is preferably provided (FIGS. 6-8).

Figure 9:
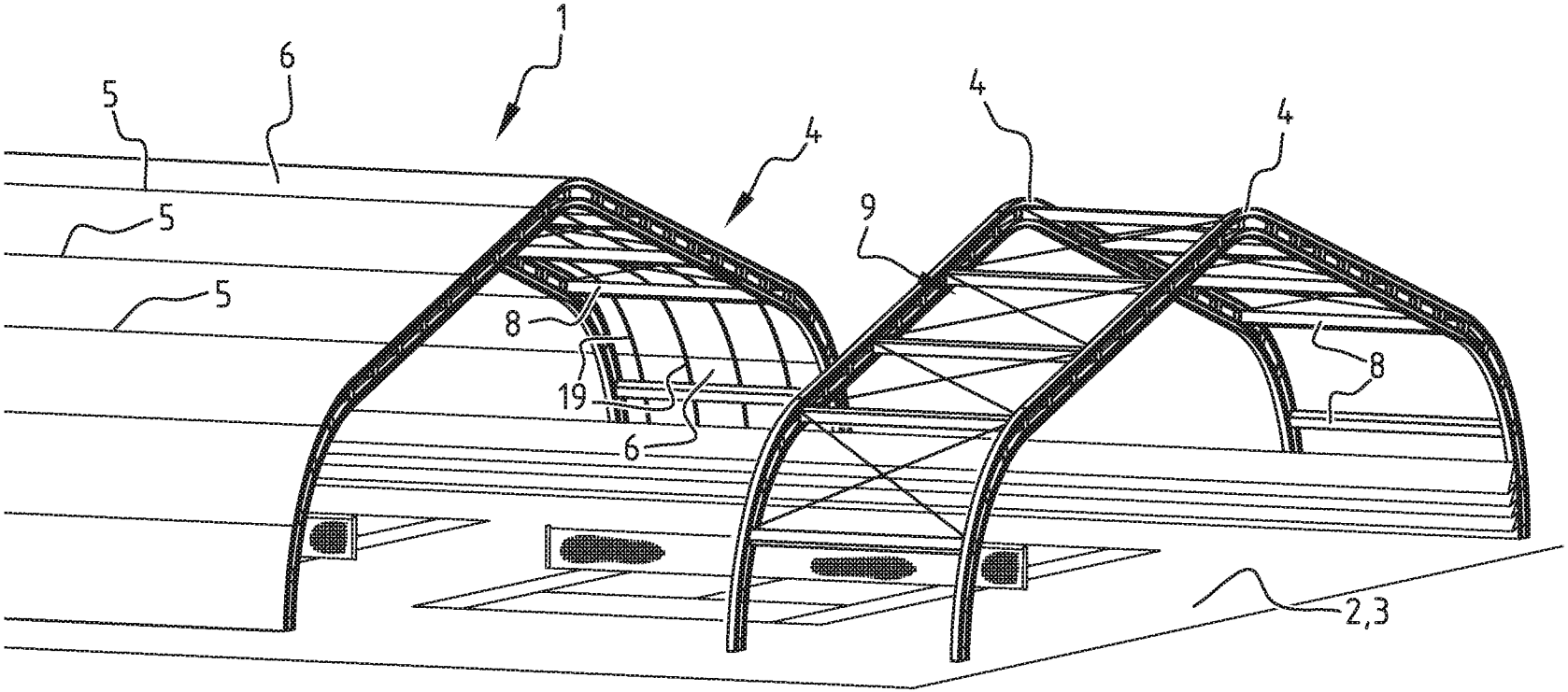
FIG. 9 shows a perspective view of a canopy according to an alternative preferred embodiment.

The detail views of FIGS. 10 and 11 further show that cross beam 5 is preferably provided with a carriage 22 which engages with running wheels 23 on beam 4. In the shown preferred embodiment running wheels 23 engage on either side of beam 4 and are arranged offset relative to each other at a distance D in a longitudinal direction of the longitudinal beam 4 (FIG. 11). This enables carriages 22 of cross beams 5 to be nested compactly, as shown in FIG. 10. As a result hereof only a limited height H (FIG. 9) is necessary for cross beams 5 in an opened position of canopy 1, which contributes to the experience of openness of area 2. For a canopy of about 40 m the height H can be limited to 2.5 to 3 m in height for a total of 17 cross beams 5.

Although they show preferred embodiments of the invention, the above described embodiments are intended solely for the purpose of illustrating the present invention and not to limit the scope of the invention in any way. It is thus noted that the term area must be widely interpreted, and comprises for instance also a swimming pool.

When measures in the claims are followed by reference numerals, such reference numerals serve only to contribute toward understanding of the claims, but are in no way limitative of the scope of protection. It is particularly noted that the skilled person can combine technical measures of the different embodiments. The rights described are defined by the following claims, within the scope of which many modifications can be envisaged.

The invention claimed is:

1. A canopy for selectively covering an area, comprising:
at least two beams which span the area;
at least first and second cross beams which are independently displaceable along the beams;
a cloth which is attached to the first cross beam;
a drive configured to displace the cross beams with the cloth attached thereto along the beams; and
an additional cloth which is attached to the second cross beam so that the additional cloth is independently movable with respect to the cloth to thereby allow the additional cloth to selectively overlap the cloth and thereby define, in an overlapping disposition of the cloth and the additional cloth, a space enclosed therebetween.

2. The canopy according to claim 1, wherein the canopy comprises at least two cross beams and a substantially flexible tensioning member fastened between the cross beams.

3. The canopy according to claim 2, wherein the tensioning member is a cord or a tensioning strap.

4. The canopy according to claim 2, wherein the beams have an arcuate form and at least one cross beam is weighted in relation to the at least one other cross beam.

5. The canopy according to claim 1, wherein one of the at least two cross beams comprise the drive.

6. The canopy according to claim 5, wherein the plurality of cross beams comprises a foremost cross beam which is the first to be displaced when moving to cover the area from an uncovered state thereof, and wherein the foremost cross beam comprises the drive.

7. The canopy according to claim 5, wherein at least one beam comprises a gear rack on which a pinion of the drive is engageable.

8. The canopy according to claim 1, wherein the additional cloth is attached to an additional cross beam, wherein the drive or an additional drive is configured to displace the additional cloth attached thereto along the beams independently of the cloth.

9. The canopy according to claim 1, wherein the cloth is provided on an outer side of the beams and the additional cloth is provided on an inner side of the beams.

10. The canopy according to claim 1, wherein one of the cloth and the additional cloth is at least one of: more water-repellent, more light-transmitting, and more thermally insulating than the other of the cloth and the additional cloth.

11. The canopy according to claim 6, wherein the plurality of cross beams which is displaceable along the beams comprises at least three cross beams.

12. The canopy according to claim 1, wherein close to an outer end the beam is curved inward, relative to a direction substantially at right angles to the area, toward the area to be covered.

13. The canopy according to claim 12, wherein a receiving gutter for the cloth is provided.

14. The canopy according to claim 1, wherein the cross beam is provided with a carriage which engages with running wheels on the beam.

15. The canopy according to claim 14, wherein the running wheels engage on either side of the beam and are arranged offset relative to each other at a distance in a longitudinal direction of the beam that is longitudinal.

16. The canopy according to claim 1, wherein the cloth and the additional cloth comprise two individual canopies which can cover or expose the area independently of each other.

* * * * *